United States Patent [19]

Nilsson

[11] Patent Number: 4,959,011

[45] Date of Patent: Sep. 25, 1990

[54] ELECTRIC IGNITION SYSTEM

[75] Inventor: Karl E. Nilsson, Ottobrunn, Fed. Rep. of Germany

[73] Assignee: Bayern-Chemie, Gesellschaft für flugchemische Antriebe mBH, Aschau, Fed. Rep. of Germany

[21] Appl. No.: 267,529

[22] Filed: Nov. 4, 1988

[30] Foreign Application Priority Data

Nov. 12, 1987 [DE] Fed. Rep. of Germany ..... 3738436

[51] Int. Cl.[5] ..... F23Q 7/06

[52] U.S. Cl. ..... 431/263; 102/202.5; 102/202.9

[58] Field of Search ..... 431/263, 258, 269; 361/248, 249, 250, 251, 252; 102/202.9, 202.5

[56] References Cited

U.S. PATENT DOCUMENTS

| | | | |
|---|---|---|---|
| 3,101,669 | 8/1963 | Gatley et al. | 102/202.9 |
| 4,271,453 | 6/1981 | Yasima et al. | 431/263 X |
| 4,621,578 | 11/1986 | Vallieres et al. | 102/202.5 X |
| 4,690,063 | 9/1987 | Granier et al. | 102/202.5 X |

*Primary Examiner*—Randall L. Green
*Attorney, Agent, or Firm*—Kenyon & Kenyon

[57] ABSTRACT

The electric ignition includes an insulating base and a primary charge mounted on the insulating base. The primary charge includes an ignition pellet, a primary ignition powder and a elastic sleeve for retaining the ignition pellet and primary ignition powder on the insulating piece. A stepped cylindrical jacket is provided to receive the primary charge. The stepped cylindrical jacket includes at least, first and second cylindrical portions of different diamters connected to one another by a radially extending step or flange. The jacket may also include a fastening means for securing the primary charge within the jacket and securing the electric ignition to a housing or the like. The jacket may further include a torusor cylindrical flange to facilitate mounting in a housing or the like. Finally, a portion of the jacket may be surrounded by a secondary ignition agent which is enclosed by an insulating sleeve fastened on the jacket.

9 Claims, 1 Drawing Sheet

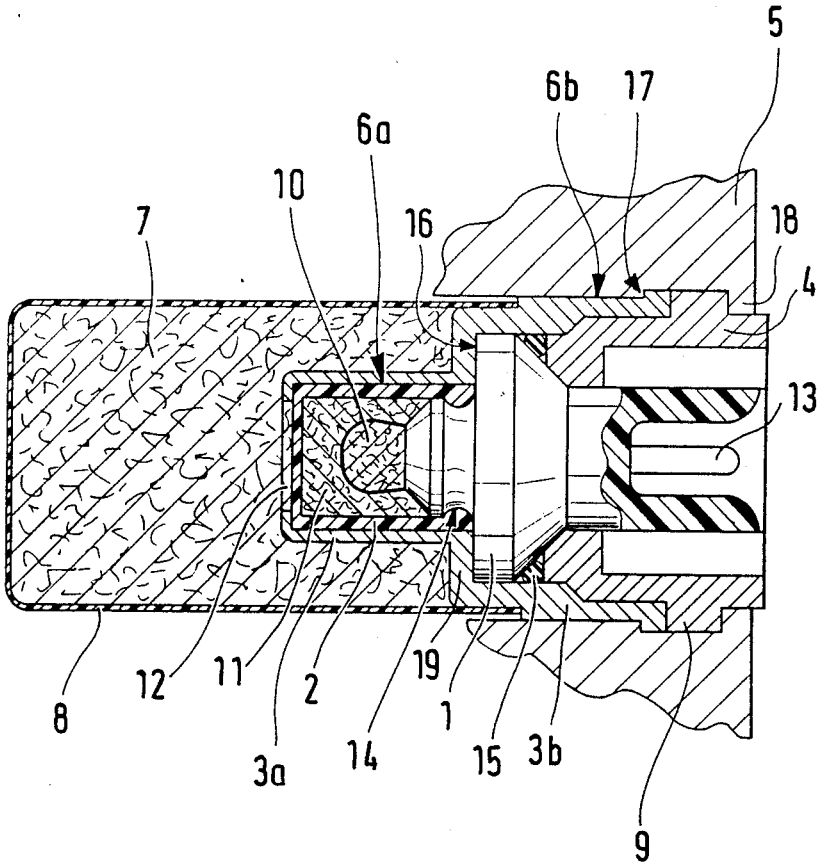
5
6b
17
6a
10
16
18
7
4
13
8
12
11
2
19
1
3a
14
15
3b
9

ELECTRIC IGNITION SYSTEM

BACKGROUND OF THE INVENTION

The present invention relates to an electric ignition system which can be used, for example, as an ignition for an air bag gas generator.

Known electric ignitions typically include an ignitor primary charge which includes an insulating base containing an electric plug, an ignitor and a primary ignition powder. In known arrangements, the ignitor is arranged on the insulating base and the primary ignition powder completely surrounds the ignitor. The primary ignition powder is enclosed by a sleeve of plastic which is placed or plugged on the base. A metal sleeve which includes a window or opening for axial ignition propagation is placed over the plastic sleeve and fastened by gluing, crimping or sealing.

A number of problems occur in the production of known ignitor primary charges of the type described above. For instance, when the metal sleeve is slipped over the plastic sleeve and glued, crimped or sealed, mechanical and thermal stresses occur which can damage the base or otherwise alter the structure of the ignitor primary charge. Such changes in the structure of the ignitor primary charge can allow moisture to intrude from the electric plug into the ignitor along the electric conductors thus impairing operation. Moreover, the insulating base may be misaligned or fastened in the metal sleeve askew such that the ignitor primary charge is not properly sealed, i.e., leaky. Finally, the known constructions are not particularly well suited for automatic manufacture and testing. Specifically, the metal sleeve is rotatable with respect to the base and there are no connecting surfaces or flanges for assembly of the ignitor charge plug in equipment.

SUMMARY OF THE INVENTION

The present invention obviates the problems associated with known ignitor primary charges used in electric ignition systems. Specifically, the present invention provides an ignitor primary charge which is easier and safer to manufacture and assemble. The electric ignition system of the present invention is particularly adapted for use in gas generators which are used, for example, in air bag devices.

The electric ignition system of the present invention includes an ignitor primary charge of the aforementioned type. Specifically, the ignitor primary charge includes an insulating base containing an electric plug, an ignitor, a primary ignition powder and a plastic sleeve placed over the base. In accordance with the present invention, the electric ignition system further includes a jacket having at least two cylindrical portions of different diameters. The two cylindrical portions of the jacket are connected to one another by a radially extending step or flange. Each of the two cylindrical portions is relatively long in the axial direction so as to provide large axially extending side faces or circumferential surfaces. The side faces or circumferential surfaces guide and support the aforementioned ignitor primary charge constituents. Specifically, the primary charge which includes the ignitor, the primary ignition powder and the plastic sleeve is fitted into the one of said two cylindrical portions, which has the smaller diameter. The insulating base is inserted into the second one of the two cylindrical portions which has a larger diameter. In particular, the insulating base is inserted into the second portion with a form fit in such a way that it rests on the radially extending step or flange. The base is also axially held by at least one fastening means. In this way, the primary charge is both guided into and maintained in the proper position. The jacket of the present invention also includes a window or opening on the first cylindrical part for axial ignition propagation.

The construction of the present invention yields a number of advantages over known constructions. For example, since the insulating base is form fitted into the second cylindrical portion of the jacket and rests against the radially extending step or flange between the first and second cylindrical jacket portions, a good seal between the jacket portion and the base is ensured. Additionally, the axial attachment of the insulating base in the jacket causes only a slight axial mechanical stress and there is no radial mechanical stress or thermal stress on the base during the assembly process. Moreover, the two cylindrical portions of the jacket include large cylindrical circumferential surfaces or side faces which contact the cylindrical surfaces of the primary charge such that a good mechanical and thermal connection from the jacket to the primary charge and to the rounding housing is obtained and protection against highfrequency irradiation is achieved. Finally, the volume available within the jacket is optimally utilized.

In accordance with an embodiment of the present invention, the smaller cylindrical jacket portion which contains the primary charge, i.e., the first cylindrical jacket portion, is surrounded by a secondary ignition powder which is enclosed by an insulating sleeve fastened on the jacket. By virtue of this construction, there is no air gap and a housing completely surrounds the secondary charge so as to ensure reliable through-ignition.

In accordance with another preferred embodiment of the present invention, the fastening means which retains the insulating base is a part of the jacket. This arrangement results in good centering of the insulating base during the production process and makes it possible to connect the ignition system to the surrounding housing in which the ignition system is to be mounted.

In accordance with yet another preferred embodiment of the present invention, a torus or a radially outwardly extending cylindrical protrusion is provided on the outer periphery of the fastening means of the jacket.

For at least the reasons mentioned above, the present invention provides the advantage of damage-free production and easy storage and transportation of the fully assembled ignition system.

BRIEF DESCRIPTION OF THE DRAWING

The drawing shows a schematically simplified section through an electric ignition system for an air bag gas generator.

DETAILED DESCRIPTION

The ignition system shown in the drawing includes sliding base 1 constructed of an insulating material such as plastic or the like. The ignition system further comprises an ignitor 10 of conventional composition and construction. The insulating base 1 contains terminal pins 13 for the ignitor 10. A primary ignition powder 11 surrounds the ignitor 10 and is embedded in a plastic sleeve 2. The plastic sleeve 2 has a reinforced edge 14 Which, as shown in the drawing, engages in a groove in insulating base 1.

In the assembled state shown in the drawing, the sleeve 2 and base 1 are surrounded by a jacket 3*a*, 3*b* of aluminum In the illustrated embodiment, the jacket comprises two parts. The jacket further comprises an axial window or opening 12 for propagation of combustion products to the secondary ignition powder 7. The jacket comprises two cylindrical portions 3*a* and 3*b*. As shown in the drawing, the first portion 3*a* has a smaller diameter than the second portion 3*b*. The first portion 3*a* is joined to the second portion 3*b* through a radially extending step or flange 19. The preassembled base which includes the insulating base 1 and the primary charge constituents, i.e., ignitor 10, primary ignition powder 11 and plastic sleeve 2, is inserted into the first jacket portion 3*a* until the insulating base 1 reaches the stop 16 at which point the base 1 is non-rotationally fixed. Subsequently, an O-ring 15 is inserted and a fastening sleeve 4 is pressed in. The jacket portion 3*b* and the fastening sleeve 4 together define a torus or cylindrical protrusion 9 which serves as a stop 17 in the housing 5 and as a counter-hold for a crimp 18. As shown in the drawing, the jacket portions 3*a* and 3*b* include large cylindrical side faces or circumferential surfaces 6*a*, 6*b* which are preferably made as large as possible to ensure a good connection between the surfaces and the surfaces which they contact.

A secondary ignition powder 7 is provided around the first jacket portion 3*a* in the region of the primary charge 10, 11 and 2. The secondary ignition powder 7 is embedded in an sleeve 8. The sleeve 8 is slipped onto the second jacket portion 3*b* and fastened thereto.

I claim:

1. An electric ignition system comprising:

an ignitor;

a base including an electrical contact, said electrical contact being in electrical contact with said ignitor;

a sleeve, said sleeve at least partially surrounding said base and being secured to said base so as to define a cavity, said ignitor being enclosed in said cavity by said sleeve and said base;

a primary ignition powder, said primary ignition powder and said ignitor substantially filling said cavity;

a jacket enclosing said base and said sleeve, said jacket comprising:

a first cylindrical portion including a window and a large axially extending circumferential surface and having a predetermined diameter, said first cylindrical portion being in contact with said sleeve;

a second cylindrical portion including a large axially extending circumferential surface having a predetermined diameter larger than the diameter of said first cylindrical portion;

and a step extending radially and connecting said first cylindrical portion to said second cylindrical portion;

wherein said first cylindrical portion encloses said sleeve, said primary ignition powder and said ignitor, and said base is form fitted with said second cylindrical portion and in abutment with said radially extending step;

at least one fastening means, said fastening means retaining said base within said second cylindrical portion.

2. The electric ignition system of claim 1, further comprising a projection extending radially outwardly from said second cylindrical portion proximate said fastening means and being received in a recess in a housing for retaining said jacket.

3. The electric ignition system of claim 1, wherein said sleeve and said base are constructed of non-conductive materials.

4. The electric ignition system of claim 1, wherein said at least one fastening means is part of said jacket.

5. The electric ignition system of claim 4, further comprising a projection extending radially outwardly from said second cylindrical portion proximate said fastening means and being received in a recess in a housing for retaining said jacket.

6. The electric ignition system of claim 1, further comprising: a secondary ignition powder, said secondary ignition powder surrounding said first cylindrical portion; and an insulating sleeve, said insulating sleeve enclosing said secondary ignition powder and being secured to said jacket.

7. The electric ignition system of claim 6, wherein said at least one fastening means is part of said jacket.

8. The electric ignition system of claim 7, further comprising a projection extending radially outwardly from said second cylindrical portion proximate said fastening means and being received in a recess in a housing for retaining said jacket.

9. The electric ignition system of claim 6, further comprising a projection extending radially outwardly from said second cylindrical portion proximate said fastening means and being received in a recess in a housing for retaining said jacket.

* * * * *